US007007750B2

(12) United States Patent
Higashiyama

(10) Patent No.: US 7,007,750 B2
(45) Date of Patent: Mar. 7, 2006

(54) HEAT EXCHANGER

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 217 days.

(21) Appl. No.: 10/468,153

(22) PCT Filed: Feb. 27, 2002

(86) PCT No.: PCT/JP02/01769

§ 371 (c)(1),
(2), (4) Date: Aug. 27, 2003

(87) PCT Pub. No.: WO02/068892

PCT Pub. Date: Sep. 6, 2002

(65) Prior Publication Data

US 2004/0144523 A1 Jul. 29, 2004

Related U.S. Application Data

(60) Provisional application No. 60/302,663, filed on Jul. 5, 2001.

(30) Foreign Application Priority Data

Feb. 28, 2001 (JP) ..... 2001-054024

(51) Int. Cl.
*F28F 9/04* (2006.01)

(52) U.S. Cl. ..... 165/178; 165/153

(58) Field of Classification Search ..... 165/152, 165/153, 178; 29/890.03
See application file for complete search history.

(56) References Cited

U.S. PATENT DOCUMENTS

| | | | | |
|---|---|---|---|---|
| 5,630,326 | A * | 5/1997 | Nishishita et al. | 165/153 |
| 5,685,366 | A * | 11/1997 | Voss et al. | 165/153 |
| 5,701,760 | A * | 12/1997 | Torigoe et al. | 165/153 |
| 5,906,237 | A * | 5/1999 | Aikawa | 165/153 |
| 5,964,281 | A * | 10/1999 | Voss et al. | 165/153 |
| 5,979,542 | A * | 11/1999 | Inoue et al. | 165/153 |
| 6,227,290 | B1 * | 5/2001 | Nishishita et al. | 165/153 |
| 6,230,787 | B1 * | 5/2001 | Koga et al. | 165/153 |
| 6,253,840 | B1 * | 7/2001 | Kuroyanagi | 165/153 |
| 6,272,881 | B1 * | 8/2001 | Kuroyanagi et al. | 165/153 |

FOREIGN PATENT DOCUMENTS

| | | |
|---|---|---|
| JP | 10-220983 | 8/1998 |
| JP | 2000-283603 | 10/2000 |
| JP | 2001-021288 | 1/2001 |
| WO | 84/03555 | 9/1984 |

* cited by examiner

*Primary Examiner*—Teresa J. Walberg
(74) *Attorney, Agent, or Firm*—Oblon, Spivak, McClelland, Maier & Neustadt, P.C.

(57) ABSTRACT

A pipe connecting member 7 has a fluid outlet passage 7B formed in communication with a fluid outlet pipe socket 721 provided thereon at a position on a lateral extension of the fluid outlet hole 9*b*, and a fluid inlet passage 7A formed with a fluid inlet pipe socket 722 provided thereon as displaced from a position on a lateral extension of the fluid inlet hole 7*a*. A corner portion 95 having a curved surface is formed between the fluid inlet passage 7A and a front header 4.

21 Claims, 5 Drawing Sheets

HEAT EXCHANGER

CROSS REFERENCE TO RELATED APPLICATIONS

This application is an application filed under 35 U.S.C. §111(a) claiming the benefit pursuant to 35 U.S.C. §119(e)(1) of the filing data of Provisional Application No. 60/302,663 filed Jul. 5, 2001 pursuant to 35 U.S.C. §111(b).

TECHNICAL FIELD

The present invention relates to heat exchangers and evaporators for motor vehicle air conditioners.

BACKGROUND ART

Heat exchangers already known for use as evaporators for motor vehicle air conditioners have a heat exchanger body which comprises a plurality of vertical flat tubes arranged laterally at a predetermined spacing and each having a front and a rear fluid channel, and a front and a rear header interconnecting upper ends of the front fluid channels of all the flat tubes and upper ends of the rear fluid channels thereof respectively and each open at one end and closed at the other end, an end plate being disposed at each of lateral outer opposite sides of the heat exchanger body, the end plate at the open end side of the two headers having a fluid inlet hole in communication with the front header and a fluid outlet hole in communication with the rear header and being provided on an outer side of an upper edge portion of the plate with a pipe connecting member, the pipe connecting member having a fluid inlet passage communicating with the fluid inlet hole and a fluid outlet passage communicating with the fluid outlet hole.

Efforts are made to reduce the front-to-rear width of evaporators for use in motor vehicle air conditioners. It is required to reduce the front-to-rear width of not only the heat exchanger body but also of the pipe connecting member, while the problem to be overcome is to suppress the increase of pressure loss involved in the width reduction.

An object of the present invention is to reduce the front-to-rear width of heat exchangers with the increase of pressure loss suppressed.,

DISCLOSURE OF THE INVENTION

The present invention provides as a first feature thereof a heat exchanger wherein a heat exchanger body comprises a plurality of vertical flat tubes arranged laterally at a predetermined spacing and each having a front and a rear fluid channel, and a front and a rear header interconnecting upper ends of the front fluid channels of all the flat tubes and upper ends of the rear fluid channels thereof respectively and each open at one end and closed at the other end, an end plate being disposed at each of lateral outer opposite sides of the heat exchanger body, the end plate at the open end side of the two headers having a fluid inlet hole in communication with the front header and a fluid outlet hole in communication with the rear header and being provided on an outer side of an upper edge portion of the plate with a pipe connecting member, the pipe connecting member having a fluid inlet passage communicating with the fluid inlet hole and a fluid outlet passage communicating with the fluid outlet hole, the heat exchanger being characterized in that the fluid outlet passage of the pipe connecting member is formed in communication with a fluid outlet pipe socket provided thereon at a position on a lateral extension of the fluid outlet hole, the fluid inlet passage of the pipe connecting member being formed in communication with a fluid inlet pipe socket provided thereon as displaced from a position on a lateral extension of the fluid inlet hole, a corner portion having a curved surface being formed between the fluid inlet passage and the front header.

With the heat exchanger according to the first feature of the invention, the fluid inlet passage of the pipe connecting member is provided as displaced from a position on a lateral extension of the fluid inlet hole, so that the front-to-rear width of the pipe connecting member can be made smaller with a reduction in the width of the heat exchanger body. Furthermore, the presence of the corner portion having a curved surface attenuates the striking contact of the fluid with the corner portion, decreasing the resistance to the flow and reducing the sound produced by the flow of fluid for the diminution of noise. Also overcome is the problem that a large amount of fluid will fall at the inlet of the front header to impair uniform distribution of the fluid to the flat tubes.

With the heat exchanger according to the first feature of the invention, the pipe connecting member comprises a generally rectangular plate portion, and a block portion provided on an outer surface of the plate portion and in the form of a projection. Preferably these two portions are made integral. In this case, the plate portion is provided with a front passageway having an open end in an upper front corner of an inner surface of the portion and another open end in a lower edge portion of an outer surface of the portion, and with a rear passageway having an open end in an upper rear corner of the inner surface of the portion and another open end in an upper rear corner of the outer surface of thereof, the plate portion being joined to an outer surface of the side plate to hold the front passageway in communication with the front header and the rear passageway in communication with the rear header. The block portion has a generally vertically elongated circular cross section and has a lengthwise direction which is an oblique direction extending from an upper rear corner of the plate portion to a lower edge portion thereof. Furthermore, the block portion is provided with passageways having a circular cross section and extending horizontally through upper and lower parts thereof respectively, the upper passageway communicating with the rear passageway of the plate portion, the lower passageway being in communication with the front passageway of the plate portion, the front passageway of the plate portion and the lower passageway of the block portion providing the fluid outlet passage, the rear passageway of the plate portion and the upper passageway of the block portion providing the fluid outlet passage. When seen from one side, the front passageway extends vertically downward and then obliquely extends rearwardly downward to communicate with an opening of the lower passageway, and when seen from the front, the front passageway has a vertical surface along the side plate on the open end side, a slanting surface opposed to the vertical surface and so inclined as to be spaced from the vertical surface by an increasing distance as the surface extends downward, an upper surface extending from the upper edge of the fluid inlet hole and a lower surface positioned slightly below the lower surface of the lower passageway, the corner portion between the upper surface and the slanting surface and a corner portion between the lower surface and the slanting surface each having a curved surface. The heat exchanger thus obtained has the advantages described and has formed therein fluid channels and passageways which are simple in construction and accurately formed.

The present invention provides as a second feature thereof a heat exchanger wherein a heat exchanger body comprises a plurality of vertical flat tubes arranged laterally at a predetermined spacing and each having a front and a rear fluid channel, and a front and a rear header interconnecting upper ends of the front fluid channels of all the flat tubes and upper ends of the rear fluid channels thereof respectively and each open at one end and closed at the other end, an end plate being disposed at each of lateral outer opposite sides of the heat exchanger body, the end plate at the open end side of the two headers having a fluid inlet hole in communication with the front header and a fluid outlet hole in communication with the rear header and being provided on an outer side of an upper edge portion of the plate with a pipe connecting member, the pipe connecting member having a fluid inlet passage communicating with the fluid inlet hole and a fluid outlet passage communicating with the fluid outlet hole, the heat exchanger being characterized in that:

the pipe connecting member comprises a plate member having an inlet communication passageway in communication with the fluid inlet hole and an outlet communication passageway in communication with the fluid outlet hole, and a block member provided on the outer side of the plate member and having an inlet passageway extending laterally and provided with a fluid inlet pipe socket at an outer end thereof and an outlet passageway extending laterally and provided with a fluid outlet pipe socket at an outer end thereof, the plate member being formed by obliquely cutting an extrudate, the extrudate being generally rectangular in cross section and having a rear passageway positioned in an upper rear corner thereof and serving as the outlet communication passageway and a front passageway positioned in an upper front corner thereof to a lower edge thereof and serving as the inlet communication passageway, the extrudate being cut along a plane inclined with respect to a plane perpendicular to the direction of extrusion thereof and having the resulting cut surface thereof held in contact with the end plate.

With the heat exchanger according to the second feature of the invention, the fluid inlet pipe socket is positioned below the fluid outlet pipe socket. This makes it possible to reduce the front-to-rear width of the pipe connecting member with a reduction in the width of the heat exchanger body. Each communication passageway in the plate member is inclined, and the angle of inflow or outflow between the passageway within the block member and this communication channel and the angle of inflow or outflow between the communication channel and the header are each an obtuse angle. This serves to attenuate the striking contact of the fluid with the corner portions, decreasing the resistance to the flow and reducing the sound produced by the flow of fluid for the diminution of noise. Also overcome is the problem that a large amount of fluid will fall at the inlet of the front header to impair uniform distribution of the fluid to the flat tubes.

With the heat exchanger according to the second feature of the invention, the rear passageway of the plate member is circular in cross section, and the front passageway thereof is generally J-shaped in cross section. The plate member is formed preferably by cutting the extrudate obliquely and thereafter chamfering an upper and a lower edge portion of the resulting cut piece having an acute angle so that the edge portions form a right angle with the cut surface thereof. It is desirable to provide a thin plate member of double-faced clad material between the plate member and the block member. Preferably, the angle of flow from the inlet passageway into the inlet communication passageway and the angle of flow from the inlet communication passageway into the front header are each an obtuse angle. The heat exchanger thus obtained has the advantages described and has formed therein fluid channels and passageways which are simple in construction and accurately formed.

The present invention provides as a third feature thereof an evaporator for motor vehicle air conditioner wherein an evaporator body comprises a plurality of vertical flat tubes arranged laterally at a predetermined spacing and each having a front and a rear fluid channel, and a front and a rear header interconnecting upper ends of the front fluid channels of all the flat tubes and upper ends of the rear fluid channels thereof respectively and each open at one end and closed at the other end, an end plate being disposed at each of lateral outer opposite sides of the evaporator body, the end plate at the open end side of the two headers having a fluid inlet hole in communication with the front header and a fluid outlet hole in communication with the rear header and being provided on an outer side of an upper edge portion of the plate with a pipe connecting member, the pipe connecting member having a fluid inlet passage communicating with the fluid inlet hole and a fluid outlet passage communicating with the fluid outlet hole, the evaporator being characterized in that the fluid outlet passage of the pipe connecting member is formed in communication with a fluid outlet pipe socket provided thereon at a position on a lateral extension of the fluid outlet hole, the fluid inlet passage of the pipe connecting member being formed in communication with a fluid inlet pipe socket provided thereon as displaced from a position on a lateral extension of the fluid inlet hole, a corner portion having a curved surface being formed between the fluid inlet passage and the front header.

With the evaporator according to the third feature of the invention, the fluid inlet passage of the pipe connecting member is provided as displaced from a position on a lateral extension of the fluid inlet hole, so that the front-to-rear width of the pipe connecting member can be made smaller with a reduction in the width of the evaporator body. Furthermore, the presence of the corner portion having a curved surface attenuates the striking contact of the fluid with the corner portion, decreasing the resistance to the flow and reducing the sound produced by the flow of fluid for the diminution of noise. Also overcome is the problem that a large amount of fluid will fall at the inlet of the front header to impair uniform distribution of the fluid to the flat tubes.

With the evaporator according to the third feature of the invention, the pipe connecting member comprises a generally rectangular plate portion, and a block portion provided on an outer surface of the plate portion and in the form of a projection. Preferably these two portions are made integral. In this case, the plate portion is provided with a front passageway having an open end in an upper front corner of an inner surface of the portion and another open end in a lower edge portion of an outer surface of the portion, and with a rear passageway having an open end in an upper rear corner of the inner surface of the portion and another open end in an upper rear corner of the outer surface of thereof, the plate portion being joined to an outer surface of the side plate to hold the front passageway in communication with the front header and the rear passageway in communication with the rear header. The block portion has a generally vertically elongated circular cross section and has a lengthwise direction which is an oblique direction extending from an upper rear corner of the plate portion to a lower edge portion thereof. Furthermore, the block portion is provided with passageways having a circular cross section and extending horizontally through upper and lower parts thereof respectively, the upper passageway communicating with the rear passageway of the plate portion, the lower passageway being in communication with the front passageway of the plate portion, the front passageway of the plate portion and the lower passageway of the block portion providing the fluid outlet passage, the rear passageway of the plate portion and the upper passageway of the block portion providing the fluid outlet passage. When seen from one side, the front passageway extends vertically downward and then obliquely extends rearwardly downward to communicate with an opening of the lower passageway, and when seen from the front, the front passageway has a vertical surface along the side plate on the open end side, a slanting surface opposed to the vertical surface and so inclined as to be spaced from the vertical surface by an increasing distance as the surface extends downward, an upper surface extending from the upper edge of the fluid inlet hole and a lower surface positioned slightly below the lower surface of the lower passageway, the corner portion between the upper surface and the slanting surface and a corner portion between the lower surface and the slanting surface each having a curved surface. The evaporator thus obtained has the advantages described and has formed therein fluid channels and passageways which are simple in construction and accurately formed.

The present invention provides as a fourth feature thereof an evaporator for motor vehicle air conditioner wherein an evaporator body comprises a plurality of vertical flat tubes arranged laterally at a predetermined spacing and each having a front and a rear fluid channel, and a front and a rear header interconnecting upper ends of the front fluid channels of all the flat tubes and upper ends of the rear fluid channels thereof respectively and each open at one end and closed at the other end, an end plate being disposed at each of lateral outer opposite sides of the evaporator body, the end plate at the open end side of the two headers having a fluid inlet hole in communication with the front header and a fluid outlet hole in communication with the rear header and being provided on an outer side of an upper edge portion of the plate with a pipe connecting member, the pipe connecting member having a fluid inlet passage communicating with the fluid inlet hole and a fluid outlet passage communicating with the fluid outlet hole, the evaporator being characterized in that:

the pipe connecting member comprises a plate member having an inlet communication passageway in communication with the fluid inlet hole and an outlet communication passageway in communication with the fluid outlet hole, and a block member provided on the outer side of the plate member and having an inlet passageway extending laterally and provided with a fluid inlet pipe socket at an outer end thereof and an outlet passageway extending laterally and provided with a fluid outlet pipe socket at an outer end thereof, the plate member being formed by obliquely cutting an extrudate, the extrudate being generally rectangular in cross section and having a rear passageway positioned in an upper rear corner thereof and serving as the outlet communication passageway and a front passageway positioned in an upper front corner thereof to a lower edge thereof and serving as the inlet communication passageway, the extrudate being cut along a plane inclined with respect to a plane perpendicular to the direction of extrusion thereof and having the resulting cut surface thereof held in contact with the end plate.

With the evaporator according to the fourth feature of the invention, the fluid inlet pipe socket is positioned below the fluid outlet pipe socket. This makes it possible to reduce the front-to-rear width of the pipe connecting member with a reduction in the width of the evaporator body. Each communication passageway in the plate member is inclined, and the angle of inflow or outflow between the passageway within the block member and this communication channel and the angle of inflow or outflow between the communication channel and the header are each an obtuse angle. This serves to attenuate the striking contact of the fluid with the corner portions, decreasing the resistance to the flow and reducing the sound produced by the flow of fluid for the diminution of noise. Also overcome is the problem that a large amount of fluid will fall at the inlet of the front header to impair uniform distribution of the fluid to the flat tubes.

With the evaporator according to the fourth feature of the invention, the rear passageway of the plate member is circular in cross section, and the front passageway thereof is generally J-shaped in cross section. The plate member is formed preferably by cutting the extrudate obliquely and thereafter chamfering an upper and a lower edge portion of the resulting cut piece having an acute angle so that the edge portions form a right angle with the cut surface thereof. It is desirable to provide a thin plate member of double-faced clad material between the plate member and the block member. Preferably, the angle of flow from the inlet passageway into the inlet communication passageway and the angle of flow from the inlet communication passageway into the front header are each an obtuse angle. The evaporator thus obtained has the advantages described and has formed therein fluid channels and passageways which are simple in construction and accurately formed.

The terms "front," "rear," "left" and "right" are herein used for the sake of convenience; such terms may be used in reverse relation to the above. Further the same advantages as above can be obtained when the inlet and the outlet for the fluid are provided in reverse relation to the above.

BEST MODE OF CARRYING OUT THE INVENTION

Figure 1:
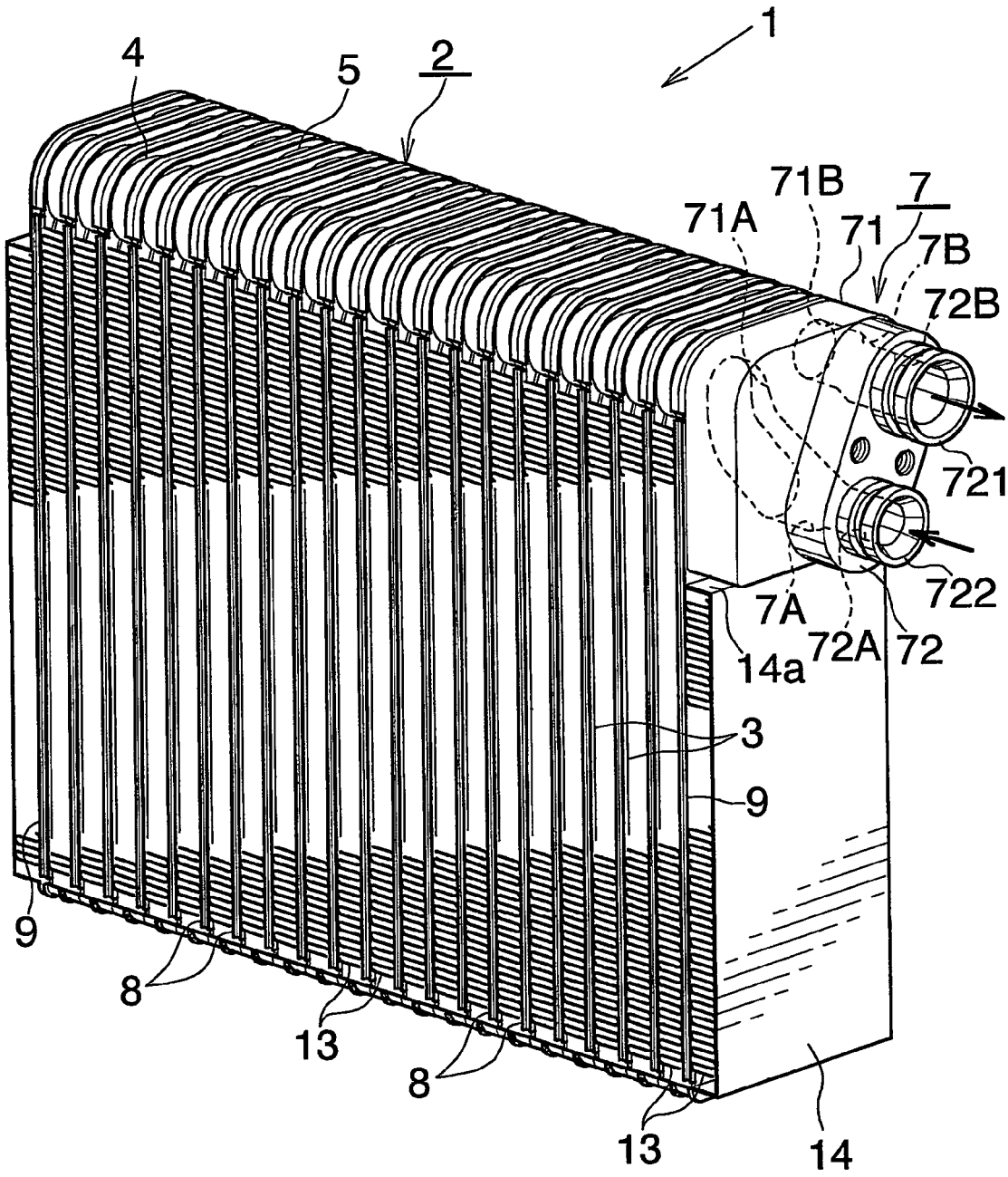
FIG. 1 is a perspective, view showing a heat exchanger of the present invention.

An embodiment of the invention according to a first feature thereof will be described with reference to FIGS. 1 to 3.

In the following description, the term "front" refers to the left-hand side of FIG. 2, the term "rear" to the right-hand side of the drawing, and the terms "left" and "right" are used for the heat exchanger as it is seen from the front rearward.

These drawings show a heat exchanger 1 for use as an evaporator for motor vehicle air conditioners. The exchanger has a heat exchanger body 2 comprising a plurality of vertical flat tubes 3 arranged laterally at a predetermined spacing and each having a front and a rear fluid channel, a front header 4 extending from left to right, interconnecting the upper ends of the front fluid channels of all the flat tubes 3 and each having an open right end and a closed left end, and a rear header 5 extending from left to right, interconnecting the upper ends of the rear fluid channels of all the flat tubes 3 and having an open right end and a closed left end. An end plate 9 is disposed at each of left and right outer sides of the heat exchanger body 2. The right end plate 9 has a fluid inlet hole 9*a* in communication with the front header 4 and a fluid outlet hole 9*b* in communication with the rear header 5. Provided on the outer side of upper edge portion of the same plate 9 is a pipe connecting member 7 having a fluid inlet passage 7A communicating with the fluid inlet hole 9*a* and a fluid outlet passage 7B communicating with the fluid outlet hole 9*b*.

The heat exchanger is one termed a layered heat exchanger of both tank type and the heat exchanger body 2 comprises an even number of intermediate plates 8 each having a front and a rear channel recessed portion 81 and upper and lower header recessed portions 82 in communication with the upper and lower ends of the recessed portions 81 and having a larger depth than the recessed portions 81, the bottom walls of the recessed portions 81, 82 of each two adjacent plates 8 being joined to each other face-to-face. A side plate 9 is joined to the intermediate plate 8 at each of the left and right ends. A laterally elongated fluid passing hole 82A is formed in the bottom wall of each header recessed portion 82 of each intermediate plate 8. All the intermediate plates 8 are fitted together in layers with the recessed portions 81, 82 of each pair of plates 8 opposed to each other to thereby form parallel front and rear flat tubes 3 and front and rear headers 4, 5 communicating with the upper and lower ends of the flat tubes 3.

No refrigerant passing hole is formed in the bottom wall of rear upper header recessed portion 82 of the intermediate plate at the center of the heat exchanger 1 with respect to the leftward or rightward direction among the many parallel intermediate plates 8, whereby the rear upper header 5 is divided into left and right two portions. In the right half of the heat exchanger 1, the front and rear header recessed portions 82 of each intermediate plate are held in communication with each other by a communication portion, so that the refrigerant can be passed from the right half of the rear upper header 5 to the right half of the front upper header 4 via the communication portions.

An outer fin 13 comprising a corrugated fin is interposed between each pair, of adjacent flat tubes 3 and joined to the outer surfaces of the tubes 3. A bent plate 14 having a horizontal bent portion 14*a* at each of its upper and lower ends is joined a the outer end of the bent portion 14*a* to the outer surface of each of the left and right side plate 9. An outer fin 13 comprising a corrugated fin is interposed between the two plates 9, 14 and joined to the respective surfaces thereof opposed to the fin.

The pipe connecting member 7 comprises a generally rectangular plate portion 71, and a block portion 72 projecting rightward from an outer surface of the plate portion 71. The two portions 71, 72 are formed integrally by casting or forging.

The plate portion 71 is provided with a front passageway 71A having an open end in the upper front corner of the inner surface of the portion 71 and another open end in the lower edge midportion of the outer surface of the portion 71, and with a rear passageway 71B having an open end in the upper rear corner of the inner surface of the portion 71 and another open end in the upper rear corner of the outer surface of thereof. The plate portion 71 is joined to the outer surface of the side plate 9 to hold the front passageway 71A in communication with the front header 4 and the rear passageway 71B in communication with the rear header 5.

The block portion 72 has a generally vertically elongated circular cross section and has a lengthwise direction which is an oblique direction extending from the upper rear corner of the plate portion 71 to the lower edge midportion thereof. The block portion 72 is provided with passageways 72B, 72A having a circular cross section and extending horizontally through upper and lower parts thereof respectively, the upper passageway 72B communicates with the rear passageway 71B of the plate portion 71, and the lower passageway 72A is in communication with the front passageway 71A of the plate portion 71.

The front passageway 71A of the plate portion 71 and the lower passageway 72A of the block portion 72 provide the fluid inlet passage 7A extending downward from the fluid inlet hole 9*a* and then extending rightward. The rear passageway 71B of the plate portion 71 and the upper passageway 72B of the block portion 72 provide the fluid outlet passage 7B extending rightward from the fluid outlet hole 9*b*. The lower passageway 72A in the block portion 72 is provided around the outer end opening thereof with an outwardly projecting annular fluid inlet pipe socket 722. The upper passageway 72B in the block portion 72 is provided around the outer end opening thereof with an outwardly projecting annular fluid outlet pipe socket 721.

Figure 2:
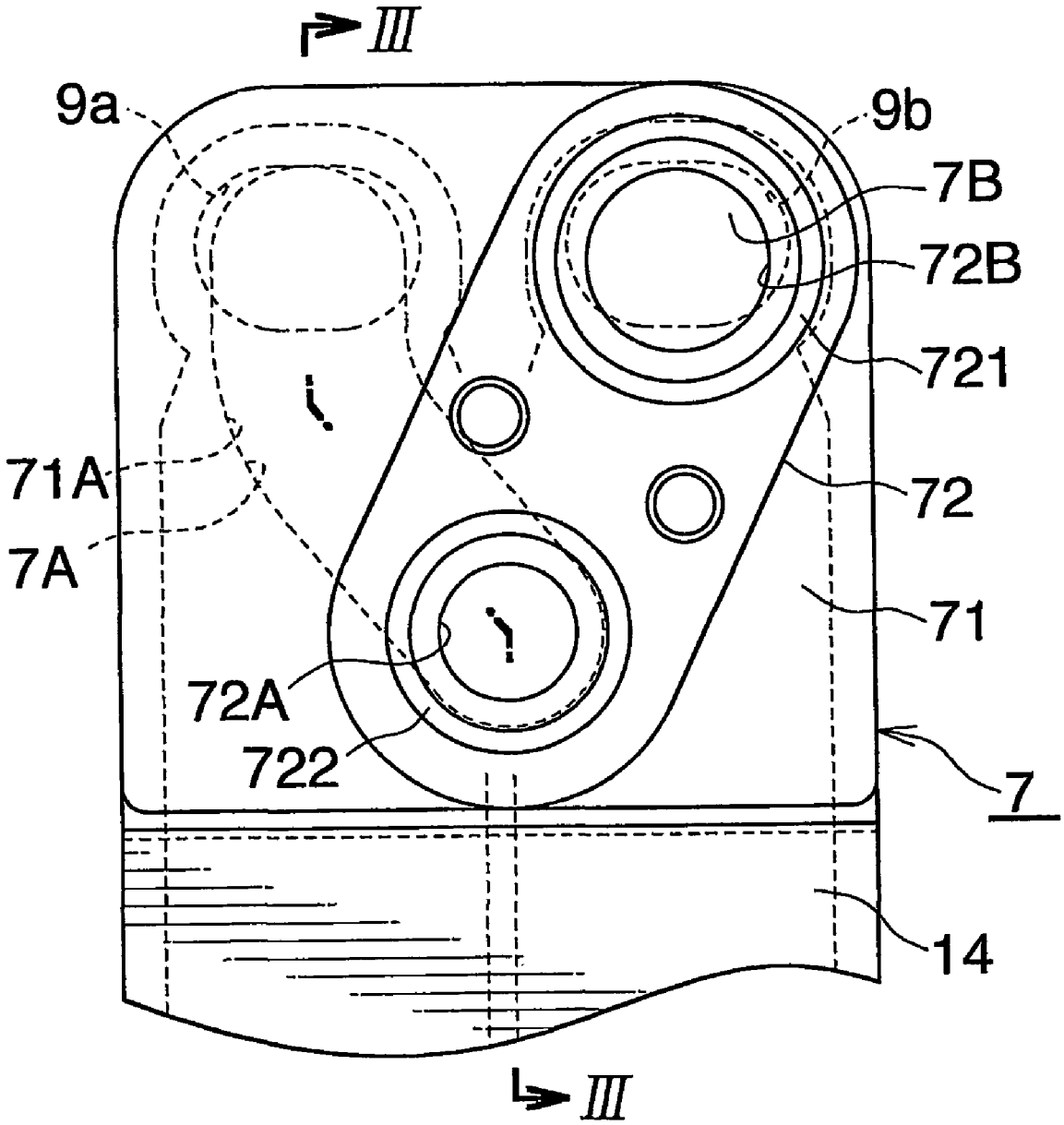
FIG. 2 is a right side elevation of the heat exchanger.
Figure 3:
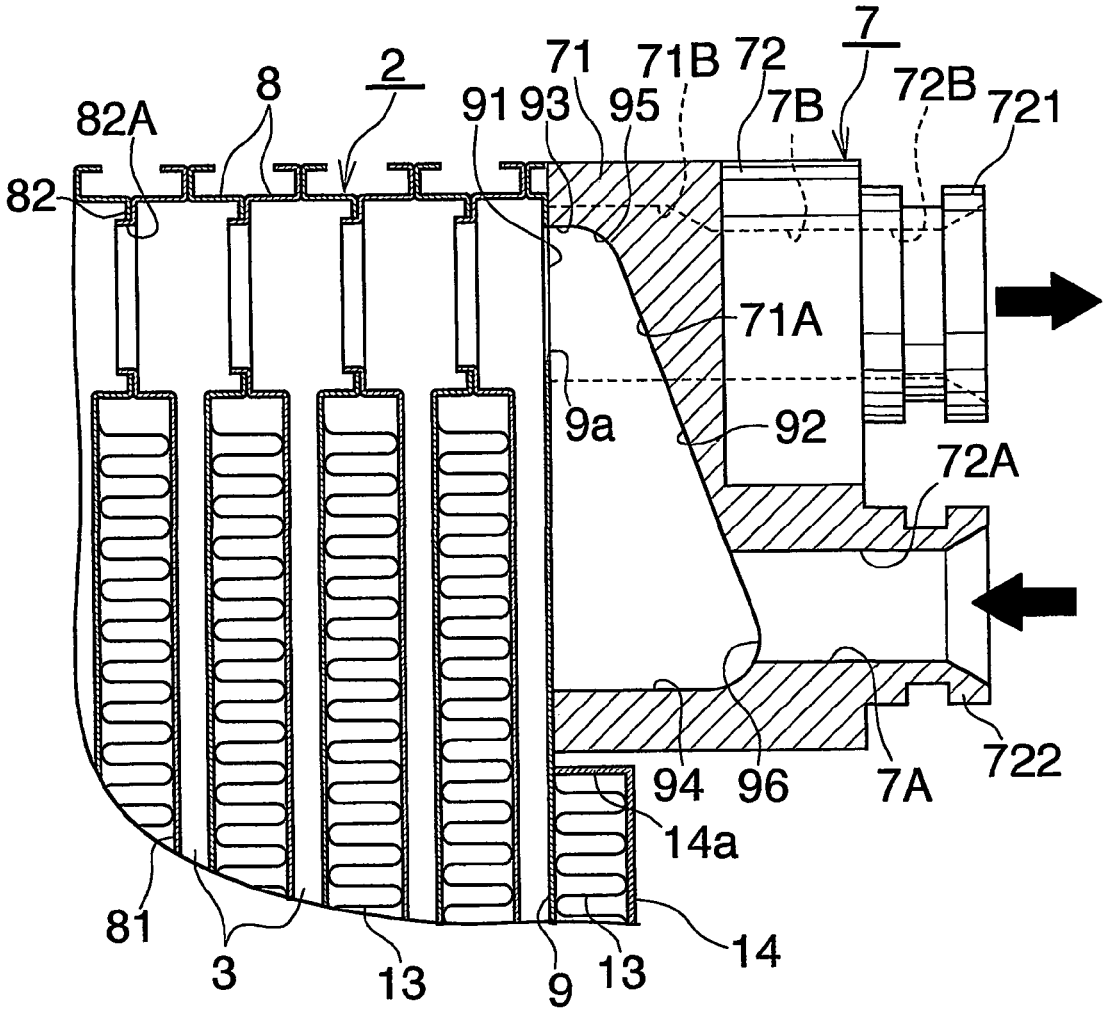
FIG. 3 is a view in section taken along the line III—III in FIG. 2 of the heat exchanger.

When seen sideways, the front passageway 71A extends downward and then obliquely extends rearwardly downward to communicate with a left-end opening of the lower passageway 72A as seen in FIG. 2. When seen from the front as shown in FIG. 3, the front passageway 71A has a left vertical surface 91 along the right side plate 9, a right slanting surface 92 inclined rightwardly downward, an upper surface 93 extending rightward from the upper edge of the plate 9 defining the fluid inlet hole 9*a* and a lower surface 94 positioned slightly below the lower surface of the lower passageway 72A. The corner portion 95 between the upper surface 93 and the right slanting surface 92 and the corner portion 96 between the lower surface 94 and the right slanting surface 92 each have a curved surface.

With the heat exchanger 1, the fluid flowing into the lower passageway 72A advances upward through the front passageway 71A and flows into the front header 4 by being guided by the corner portion 95 between the right slanting surface 92 of the passageway 71A and the front header 4. The fluid then flows through the heat exchanger body 2 and is discharged from the fluid outlet passage 7B via the rear header 5. The presence of the curved corner portion 95 attenuates the striking contact of the fluid with the corner portion 95 to reduce the resistance against the flow unlike the heat exchanger having a front passageway wherein an upper surface and a right vertical surface are at a right angle, consequently solving the problem that a large amount of fluid balls at the right end portion of the header 4 to impair uniform fluid distribution to the flat tubes 3. When seen from the front, the upper surface 93 of the front passageway 71A may be flush and in alignment with the upper edge of the plate 9 defining the fluid inlet hole 9*a*, or may alternatively be in the form of a curve as an extension of the corner portion 95. The right slanting surface 92 may be a vertical surface (not shown), but if it is an inclined surface as illustrated, the angle of deflection from the front passageway 71A toward the front header 4 becomes an obtuse angle. This leads to an effect to reduce the resistance to flow by diminishing an abrupt change in the direction of flow of the fluid.

Among the components of the heat exchanger 1 described, the intermediate plates 8, side plates 9 and bent plates 14 are prepared from double-faced aluminum brazing sheets. The heat exchanger 1 is fabricated by preliminarily assembling the components 8, 9, 14, 13, 7 using jigs and thereafter brazing the assembly in a furnace.

Figure 4:
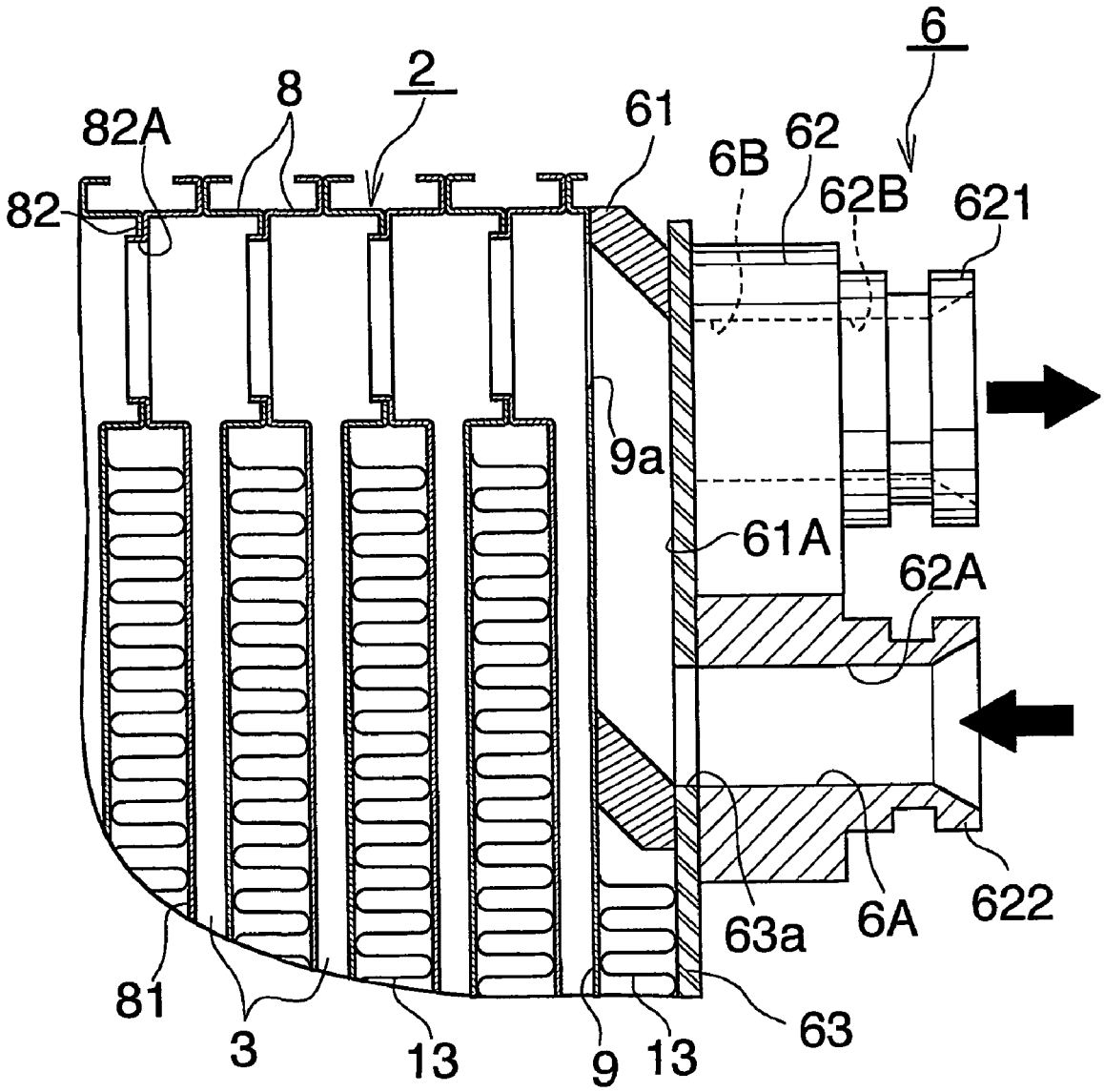
FIG. 4 is a view corresponding to FIG. 3 and showing a second-embodiment of the invention.
Figure 5:
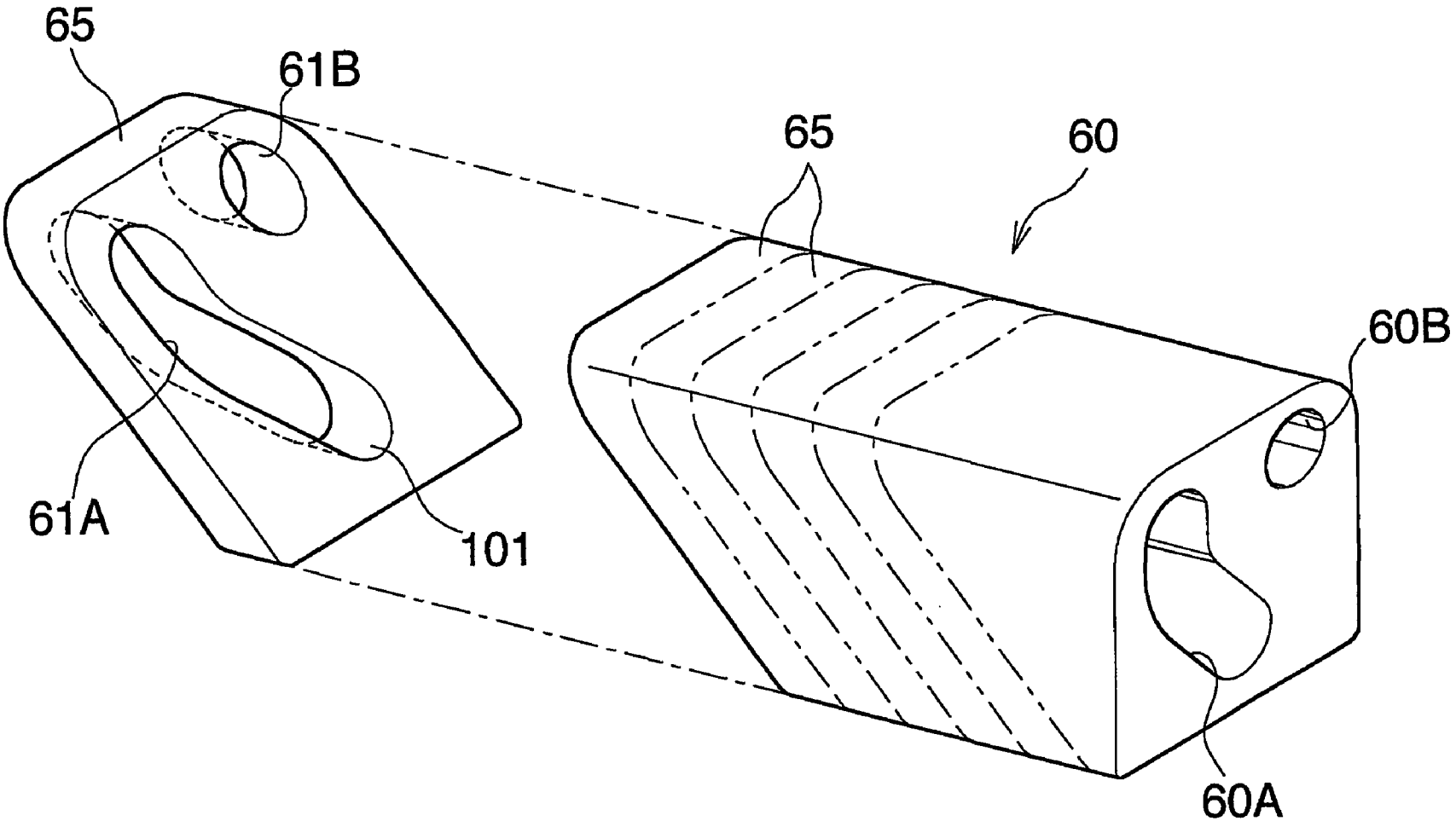
FIG. 5 is a perspective view showing a process for making a plate portion of heat exchanger according to the second feature of the invention.

The plate portion 71 and the block portion 72 of the heat exchanger 1 according to the first feature of the invention are formed integrally, but may alternatively be prepared as separate parts. FIGS. 4 and 5 show an embodiment of heat exchanger according to a second feature of the invention, i.e., an example in which a plate member is made (as by casting or forging) as a member separate from a block member.

With reference to these drawings, pipe connecting member 6 comprises a plate member 61 having an inlet communication passageway 61A communicating with the fluid inlet hole 9*a* and an outlet communication passageway 61B communicating with the fluid outlet hole 9*b*, a block member 62 provided on the outer surface of the plate member 61 and having an inlet passageway 62A which extends rightward and is provided with a fluid inlet pipe socket 622 at its right end and an outlet passageway 62B which extends rightward and is provided with a fluid outlet pipe socket 621 at its right end, and a thin plate member 63 provided between the two members 61, 62.

The plate member 61 is made by cutting an extrudate 60. As shown in FIG. 5, the extrudate 60 is generally rectangular in cross section and has a rear passageway 60B of circular cross section positioned in the upper rear corner thereof and serving as the outlet communication passageway 61B, and a front passageway 60A of generally J-shaped cross section positioned in the upper front corner to a lower edge portion and serving as the inlet communication passageway 61A. Oblique cut pieces 65 having slanting upper and lower surfaces for use as plate members are prepared by cutting the extrudate 60 along planes inclined (e.g., at an angle of 45 degrees) with respect to a plane perpendicular to the direction of extrusion of the extrudate 60.

After the extrudate 60 is cut, the resulting oblique cut piece 65 is so chamfered that the upper and lower edges thereof with an acute angle have a right angle with a cut surface thereof. As shown in FIG. 4, the plate member 61 thus obtained has its cut surface held in contact with the right end plate 9 so as to incline the communication passageways 61A, 61B thereof rightwardly downward. The thin plate member 63 is made from a double-faced clad material and provided with communication holes 63*a* at the respective portions thereof corresponding to the inlet passageway 62A and the outlet passageway 62B of the block portion 62. The inlet communication passageway 61A of the plate portion 61 and the inlet passageway 62A of the block portion 62 provide a fluid inlet passage 6A extending downward from the fluid inlet hole 9*a* and then extending rightward. The outlet communication passageway 61B of the plate portion 61 and the outlet passageway 62B of the block portion 62 provide a fluid outlet passage 6B extending rightward from the fluid outlet hole 9*b*.

With the heat exchanger according to the second feature of the invention, the fluid flowing into the inlet passageway 62A advances upward through the inlet communication passageway 61A into the front header 4. The fluid flows through the heat exchanger body 2 and is discharged from the fluid outlet passage 6B via the rear header 5. The angle of flow from the inlet passageway 62A into the inlet communication passageway 61A and the angle of flow from the passageway 61A into the front header 4 are each an obtuse angle (e.g., 145 degrees), so that the striking contact of the fluid with the corner portions offer smaller resistance against the flow than in heat exchangers wherein these inflow angles are right angles. This overcomes the problem that a large quantity of fluid will fall at the right end portion of the header 4 to impair uniform distribution of fluid to the flat tubes 3.

Although the heat exchanger 1 described is of the type wherein headers 4, 5 are provided at its upper and lower sides, the invention is similarly applicable to heat exchangers wherein headers are provided only at the upper side.

Furthermore the heat exchanger of the invention is useful not only as an evaporator for motor vehicle air conditioners but also as an oil cooler, aftercooler, radiator or for other application.

What is claimed is:

1. A heat exchanger wherein a heat exchanger body comprises a plurality of vertical flat tubes arranged laterally at a predetermined spacing and each having a front and a rear fluid channel, and a front and a rear header interconnecting upper ends of the front fluid channels of all the flat tubes and upper ends of the rear fluid channels thereof respectively and each open at one end and closed at the other end, an end plate being disposed at each of lateral outer opposite sides of the heat exchanger body, the end plate at the open end side of the two headers having a fluid inlet hole in communication with the front header and a fluid outlet hole in communication with the rear header and being provided on an outer side of an upper edge portion of the plate with a pipe connecting member, the pipe connecting member having a fluid inlet passage communicating with the fluid inlet hole and a fluid outlet passage communicating with the fluid outlet hole, wherein the fluid outlet passage of the pipe connecting member is formed in communication with a fluid outlet pipe socket provided thereon at a position on a lateral extension of the fluid outlet hole, the fluid inlet passage of the pipe connecting member being formed in communication with a fluid inlet pipe socket provided thereon as displaced from a position on a lateral extension of the fluid inlet hole, and wherein the end plate is flat, the pipe connecting member comprises a generally rectangular plate portion, and a block portion provided on an outer surface of the plate portion and in the form of a projection, the two portions being integral, and the pipe connecting member has a corner portion having a curved surface being formed between the fluid inlet passage and the front header.

2. A heat exchanger according to claim 1 wherein the plate portion is provided with a front passageway having an open end in an upper front corner of an inner surface of the portion and another open end in a lower edge portion of an outer surface of the portion, and with a rear passageway having an open end in an upper rear corner of the inner surface of the portion and another open end in an upper rear corner of the outer surface of thereof, the plate portion being joined to an outer surface of the side plate to hold the front passageway in communication with the front header and the rear passageway in communication with the rear header.

3. A heat exchanger according to claim 1 wherein the block portion has a generally vertically elongated circular cross section and has a lengthwise direction which is an oblique direction extending from an upper rear corner of the plate portion to a lower edge portion thereof.

4. A heat exchanger according to claim 3 wherein the block portion is provided with passageways having a circular cross section and extending horizontally through upper and lower parts thereof respectively, the upper passageway communicating with the rear passageway of the plate portion, the lower passageway being in communication with the front passageway of the plate portion, the front passageway of the plate portion and the lower passageway of the block portion providing the fluid inlet passage, the rear passageway of the plate portion and the upper passageway of the block portion providing the fluid outlet passage.

5. A heat exchanger according to claim 2 wherein when seen from one side, the front passageway extends vertically downward and then obliquely extends rearwardly downward to communicate with an opening of the lower passageway, and when seen from the front, the front passageway has a vertical surface along the side plate on the open end side, a slanting surface opposed to the vertical surface and so inclined as to be spaced from the vertical surface by an increasing distance as the surface extends downward, an upper surface extending from the upper edge of the fluid inlet hole and a lower surface positioned slightly below the lower surface of the lower passageway, the corner portion between the upper surface and the slanting surface and the corner portion between the lower surface and the slanting surface each having a curved surface.

6. A heat exchanger wherein a heat exchanger body comprises a plurality of vertical flat tubes arranged laterally at a predetermined spacing and each having a front and a rear fluid channel, and a front and a rear header interconnecting upper ends of the front fluid channels of all the flat tubes and upper ends of the rear fluid channels thereof respectively and each open at one end and closed at the other end, an end plate being disposed at each of lateral outer opposite sides of the heat exchanger body, the end plate at the open end side of the two headers having a fluid inlet hole in communication with the front header and a fluid outlet hole in communication with the rear header and being provided on an outer side of an upper edge portion of the plate with a pipe connecting member, the pipe connecting member having a fluid inlet passage communicating with the fluid inlet hole and a fluid outlet passage communicating with the fluid outlet hole, the heat exchanger being characterized in that:

the pipe connecting member comprises a plate member having an inlet communication passageway in communication with the fluid inlet hole and an outlet communication passageway in communication with the fluid outlet hole, and a block member provided on the outer side of the plate member and having an inlet passageway extending laterally and provided with a fluid inlet pipe socket at an outer end thereof and an outlet passageway extending laterally and provided with a fluid outlet pipe socket at an outer end thereof, the plate member being formed by obliquely cutting an extrudate, the extrudate being generally rectangular in cross section and having a rear passageway positioned in an upper rear corner thereof and serving as the outlet communication passageway and a front passageway positioned in an upper front corner thereof to a lower edge thereof and serving as the inlet communication passageway, the extrudate being cut along a plane inclined with respect to a plane perpendicular to the direction of extrusion thereof and having the resulting cut surface thereof held in contact with the end plate.

7. A heat exchanger according to claim 6 wherein the rear passageway of the plate member is circular in cross section, and the front passageway thereof is generally J-shaped in cross section.

8. A heat exchanger according to claim 6 wherein the plate member is formed by cutting the extrudate obliquely and thereafter chamfering an upper and a lower edge portion of the resulting cut piece having an acute angle so that the edge portions form a right angle with the cut surface thereof.

9. A heat exchanger according to claim 6 wherein a thin plate member of double-faced clad material is provided between the plate member and the block member.

10. A heat exchanger according to claim 6 wherein the angle of flow from the inlet passageway into the inlet communication passageway and the angle of flow from the inlet communication passageway into the front header are each an obtuse angle.

11. An evaporator for motor vehicle air conditioner wherein an evaporator body comprises a plurality of vertical flat tubes arranged laterally at a predetermined spacing and each having a front and a rear fluid channel, and a front and a rear header interconnecting upper ends of the front fluid channels of all the flat tubes and upper ends of the rear fluid channels thereof respectively and each open at one end and closed at the other end, an end plate being disposed at each of lateral outer opposite sides of the evaporator body, the end plate at the open end side of the two headers having a fluid inlet hole in communication with the front header and a fluid outlet hole in communication with the rear header and being provided on an outer side of an upper edge portion of the plate with a pipe connecting member, the pipe connecting member having a fluid inlet passage 7A communicating with the fluid inlet hole and a fluid outlet passage communicating with the fluid outlet hole, wherein the fluid outlet passage of the pipe connecting member is formed in communication with a fluid outlet pipe socket provided thereon at a position on a lateral extension of the fluid outlet hole, the fluid inlet passage of the pipe connecting member being formed in communication with a fluid inlet pipe socket provided thereon as displaced from a position on a lateral extension of the fluid inlet hole, and wherein the end plate is flat, the pipe connecting member comprises a generally rectangular plate portion, and a block portion provided on an outer surface of the plate portion and in the form of a projection, the two portions being integral, and the pipe connecting member has a corner portion having a curved surface being formed between the fluid inlet passage and the front header.

12. An evaporator for motor vehicle air conditioner according to claim 11 wherein the pipe connecting member comprises a generally rectangular plate portion, and a block portion provided on an outer surface of the plate portion and in the form of a projection, the two portions being integral.

13. An evaporator for motor vehicle air conditioner according to claim 12 wherein the plate portion is provided with a front passageway having an open end in an upper front corner of an inner surface of the portion and another open end in a lower edge portion of an outer surface of the portion, and with a rear passageway having an open end in an upper rear corner of the inner surface of the portion and another open end in an upper rear corner of the outer surface of thereof, the plate portion being joined to an outer surface of the side plate to hold the front passageway in communication with the front header and the rear passageway in communication with the rear header.

14. An evaporator for motor vehicle air conditioner according to claim 12 wherein the block portion has a generally vertically elongated circular cross section and has a lengthwise direction which is an oblique direction extending from an upper rear corner of the plate portion to a lower edge portion thereof.

15. An evaporator for motor vehicle air conditioner according to claim 14 wherein the block portion is provided with passageways having a circular cross section and extending horizontally through upper and lower parts thereof respectively, the upper passageway communicating with the rear passageway of the plate portion, the lower passageway being in communication with the front passageway of the plate portion, the front passageway of the plate portion and the lower passageway of the block portion providing the fluid inlet passage, the rear passageway of the plate portion and the upper passageway of the block portion providing the fluid outlet passage.

16. An evaporator for motor vehicle air conditioner according to claim 15 wherein when seen from one side, the front passageway extends vertically downward and then obliquely extends rearwardly downward to communicate with an opening of the lower passageway, and when seen from the front, the front passageway has a vertical surface along the side plate on the open end side, a slanting surface opposed to the vertical surface and so inclined as to be spaced from the vertical surface by an increasing distance as the surface extends downward, an upper surface extending from the upper edge of the fluid inlet hole and a lower surface positioned slightly below the lower surface of the lower passageway, the corner portion between the upper surface and the slanting surface and the corner portion between the lower surface and the slanting surface each having a curved surface.

17. An evaporator for motor vehicle air conditioner wherein an evaporator body comprises a plurality of vertical flat tubes arranged laterally at a predetermined spacing and each having a front and a rear fluid channel, and a front and a rear header interconnecting upper ends of the front fluid channels of all the flat tubes and upper ends of the rear fluid channels thereof respectively and each open at one end and closed at the other end, an end plate being disposed at each of lateral outer opposite sides of the evaporator body, the end plate at the open end side of the two headers having a fluid inlet hole in communication with the front header and a fluid outlet hole in communication with the rear header and being provided on an outer side of an upper edge portion of the plate with a pipe connecting member, the pipe connecting member having a fluid inlet passage communicating with the fluid inlet hole and a fluid outlet passage communicating with the fluid outlet hole, the evaporator being characterized in that:

the pipe connecting member comprises a plate member having an inlet communication passageway in communication with the fluid inlet hole and an outlet communication passageway in communication with the fluid outlet hole, and a block member provided on the outer side of the plate member and having an inlet passageway extending laterally and provided with a fluid inlet pipe socket at an outer end thereof and an outlet passageway extending laterally and provided with a fluid outlet pipe socket at an outer end thereof, the plate member being formed by obliquely cutting an extrudate, the extrudate being generally rectangular in cross section and having a rear passageway positioned in an upper rear corner thereof and serving as the outlet communication passageway and a front passageway positioned in an upper front corner thereof to a lower edge thereof and serving as the inlet communication passageway, the extrudate being cut along a plane inclined with respect to a plane perpendicular to the direction of extrusion thereof and having the resulting cut surface thereof held in contact with the end plate.

18. An evaporator for motor vehicle air conditioner according to claim 17 wherein the rear passageway of the plate member is circular in cross section, and the front passageway thereof is generally J-shaped in cross section.

19. An evaporator for motor vehicle air conditioner according to claim 17 wherein the plate member is formed by cutting the extrudate obliquely and thereafter chamfering an upper and a lower edge portion of the resulting cut piece having an acute angle so that the edge portions form a right angle with the cut surface thereof.

20. An evaporator for motor vehicle air conditioner according to claim 17 wherein a thin plate member of double-faced clad material is provided between the plate member and the block member.

21. An evaporator for motor vehicle air conditioner according to claim 17 wherein the angle of flow from the inlet passageway into the inlet communication passageway and the angle of flow from the inlet communication passageway into the front header are each an obtuse angle.

* * * * *